US007234628B2

(12) United States Patent
Remaks et al.

(10) Patent No.: US 7,234,628 B2
(45) Date of Patent: Jun. 26, 2007

(54) CONTAINER WITH HAZARD WARNING FEATURE

(75) Inventors: William J. Remaks, Louisville, KY (US); Ronald D. Timbrook, Edgerton, OH (US)

(73) Assignee: Weyerhaeuser Co., Federal Way, WA (US)

( * ) Notice: Subject to any disclaimer, the term of this patent is extended or adjusted under 35 U.S.C. 154(b) by 808 days.

(21) Appl. No.: 10/209,736

(22) Filed: Jul. 31, 2002

(65) Prior Publication Data

US 2003/0042297 A1 Mar. 6, 2003

Related U.S. Application Data

(60) Provisional application No. 60/316,012, filed on Aug. 29, 2001.

(51) Int. Cl.
*B65D 5/00* (2006.01)

(52) U.S. Cl. ..... 229/109; 206/459.5; 206/459.1

(58) Field of Classification Search ..... 229/109; 206/459.5, 459.1

See application file for complete search history.

(56) References Cited

U.S. PATENT DOCUMENTS

| | | | | | |
|---|---|---|---|---|---|
| D90,803 | S | * | 10/1933 | Cummings | D9/433 |
| D132,923 | S | * | 6/1942 | McInTosh | D9/433 |
| 2,565,188 | A | * | 8/1951 | Welshenbach | 229/109 |
| 3,373,922 | A | * | 3/1968 | Watts | 206/459.5 X |
| 4,225,078 | A | * | 9/1980 | Croley | 229/109 |
| 4,441,649 | A | | 4/1984 | Nederveld | |
| 4,899,927 | A | * | 2/1990 | Straub et al. | 229/109 |
| 5,178,275 | A | * | 1/1993 | Fitzgerald et al. | 206/386 |
| 5,259,550 | A | * | 11/1993 | Kuchenbecker | 229/109 |
| 5,746,318 | A | * | 5/1998 | Batchelor | 206/494 |
| 6,059,179 | A | * | 5/2000 | Giampapa | 229/103 |

OTHER PUBLICATIONS

Questar Boxes (http://www.questarusa.com/boxes/boxes.htm).*
The Wiley Encyclopedia of Packaging technology, 1986, pp. 204,216,217.*

* cited by examiner

*Primary Examiner*—Tri M. Mai

(57) ABSTRACT

The present invention includes a blank and container wherein the container includes truncated corner panels and the container is configured to attach or otherwise sit upon a supporting structure, such as, without limitation, a pallet. The truncated corners of the container coupled with the non-truncated corners of the supporting structure cause the corners of the supporting structure to extend beyond the perimeter of the container. Corner tabs having hazard-warning indicia upon an upper surface are configured to extend over the exposed supporting structure corners. Consequently, attention is drawn to the extended supporting structure corners thereby helping to prevent tripping over the pallet corners The indicia may be brightly colored stripes, solid fields or any other indicia. The indicia may be printed and formed in same process as printing labels on the container, thereby requiring no additional manufacturing steps.

11 Claims, 4 Drawing Sheets

CONTAINER WITH HAZARD WARNING FEATURE

RELATED APPLICATIONS

This application claims priority to U.S. Provisional Application No. 60/316,012 filed Aug. 29, 2001, the benefit of which is hereby claimed under 35 U.S.C. 119(e).

FIELD OF INVENTION

The present invention is relates to corrugated pallet bins, and more specifically to, warning indicators for corrugated pallet bins.

BACKGROUND OF THE INVENTION

Large corrugated material containers, such as pallet sized bulk bins, are created for a variety of purposes. For example, the containers are used for storing, shipping or displaying relatively heavy produce such as watermelons, cantaloupes, and bagged apples. In use, these containers are generally mounted on or attached to pallets or similar structure for ease of storing or moving the container. Generally, the container design is typically a modified square or rectangular shaped with truncated corner regions. However, the truncated shape of the containers potentially creates a potentially hazardous problem because the pallet corners extend outside the truncated corners. A person may not notice the pallet corners and trip over them.

FIG. 1 is an example of a container blank 20 used to make current, bulk-bin type containers. The blank 20 includes a plurality of sidewall panels 4, 4', 8, 8', corner panels 6, 6', 6", 6'", bottom panels 10, 10', 12, 12', and glue flap 2 all hingedly connected to one another along various hinge lines. The bottom panels 10, 10' and 12, 12' are separated from each other by corner regions 32, 32', 32", 32'" which are disposed adjacent corner panels 6, 6', 6", 6'".

SUMMARY OF THE INVENTION

The invention comprises a modified octagonal palletized shipping and display bin which has four triangular tabs designed into the bottom flap configuration. These tabs overlie the exposed supporting structure corners and may have various warning indicia printed on them to alert passers by. The indicia may be stripes, solid fields, or other patterns usually printed in bright colors so as to be readily seen. So-called "day glow" colors are very effective. The tabs act as warning flags to alert nearby people to the potential hazard condition. They can be printed at the same time and on the same surface as other material that might appear on the sides of the bins.

The warning tabs are readily formed when the corrugated paperboard blanks for the bins are cut out. They do not complicate the process in any manner or require additional material since they are formed from material that would have been previously trimmed out as scrap. The tabs remain attached to the bottoms of the corner panels allowing them to be bent outwardly during the bin setup process. They effectively cover the exposed corners of the pallets while remaining firmly attached to the bin itself.

DETAILED DESCRIPTION OF THE PREFERRED EMBODIMENTS

Figure 1:
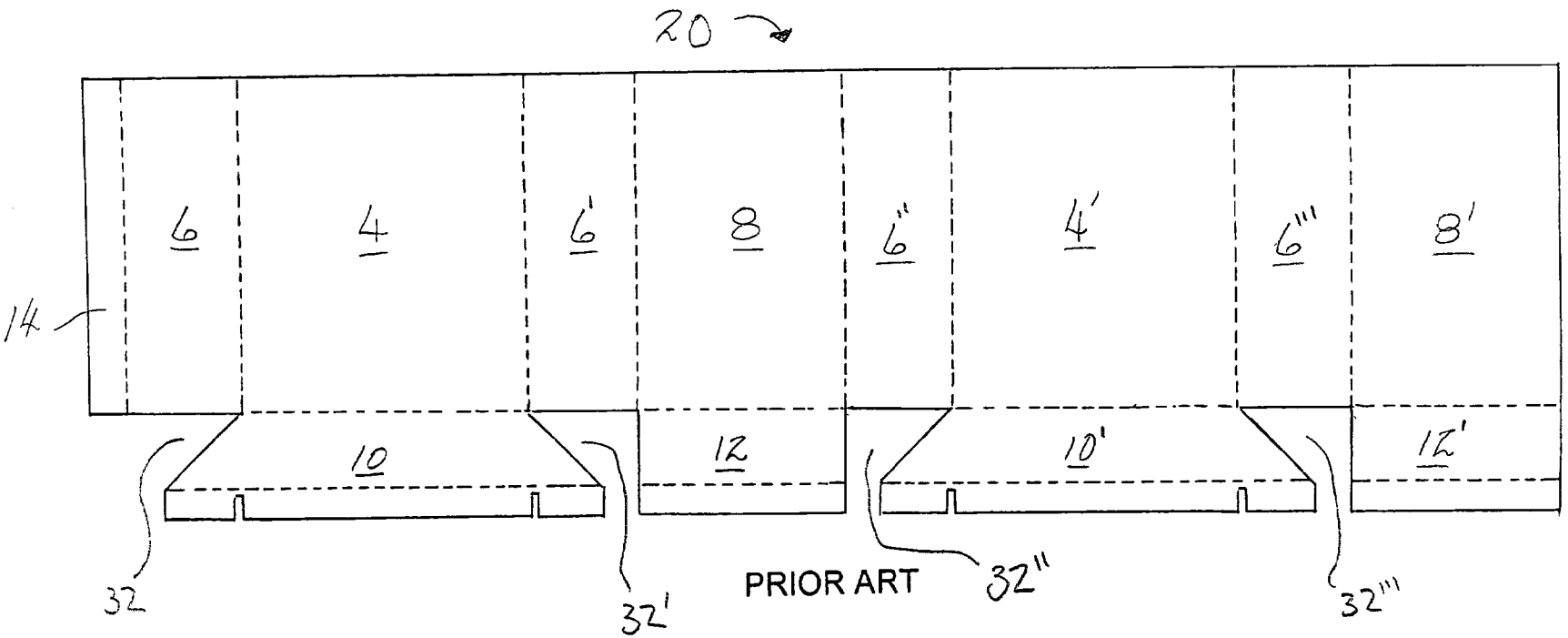
PRIOR ART Fig. 1
FIG. 1 is a plan view of a blank of a prior art pattern.
Figure 2:
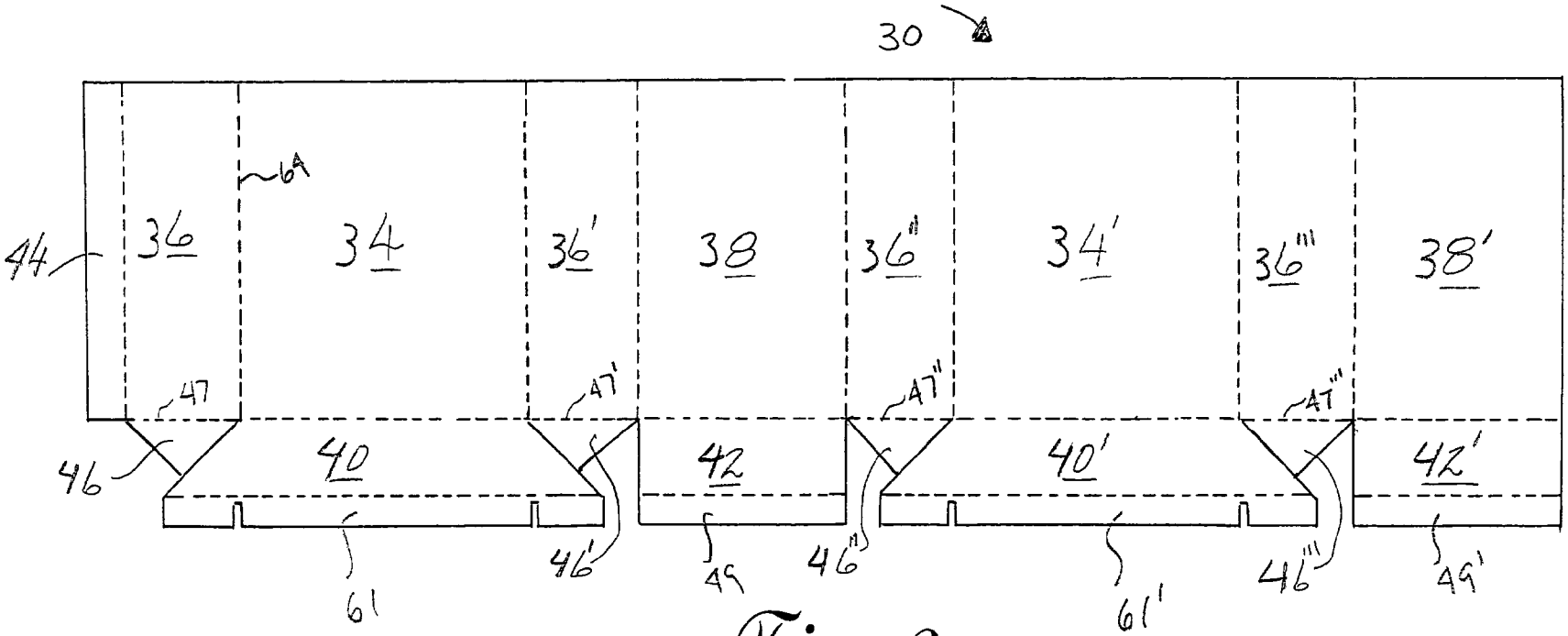
FIG. 2 is a plan view of a blank according to the present invention.

The present invention provides a safety indicator for containers that are placed upon or otherwise connected to pallets or other shipping structure. FIG. 2 depicts the blank 30 used to form the container 54. The blank 30 is preferably constructed from a single piece of formable material, such as, without limitation, corrugated material. More specifically, the blank 30 is preferably constructed from a corrugated material having a plurality of corrugated sections. The blank 30 is cut, scored, perforated or otherwise formed to include a plurality of panels which, when assembled, create the container 54 of the present invention. Wherever possible the same number is used in related panels of the container 54. More specifically, in all FIGURES, like numbers indicate like parts. Additionally, cuts are shown as solid lines, score lines as dashed lines and lines of perforations as broken lines.

With reference to FIGS. 2-5, the single piece blank 30 is preferably configured to form a generally octagon shaped container 54. More specifically, the blank 30 is preferably configured to form a container 54 with substantially identical, opposed primary sidewalls 34, 34' and substantially identical, opposed secondary sidewalls 38, 38'. Interposed between the primary sidewalls 34, 34' and secondary sidewalls 38, 38' are corner walls 36, 36', 36", 36'". The primary bottom flaps 40, 40' and secondary bottom flaps 42, 42', form the bottom region of the container 54. The resulting octagon shaped container 54 is roughly rectangular or square with truncated corner walls 36, 36', 36", 36'".

The container 54 is formed by fastening side flap 44 to sidewall 38'. The side flap 44 may be fastened to sidewall 38' by any variety of fastening methods, such as, without limitation, a glue, other adhesive material, staples, clips or any combinations thereof.

The corner tabs 46, 46', 46", 46'" are substantially triangular shaped elements that are hingedly attached to the corner walls 36, 36', 36", 36'" along hinge lines 47, 47', 47", 47'", respectively. The width of the corner tabs 46, 46', 46", 46'" at the hinge line is equal to the width of corner walls 36, 36', 36", 36'". In the formed container 54, the outer edges of the corner tabs are aligned with the primary sidewalls 34, 34' and secondary sidewalls 38, 38'.

The substantially trapezoidal shaped primary bottom flaps 40, 40' are hingedly attached to the primary sidewalls 34, 34'. The side edges of the primary bottom flaps 40, 40' are angled to align with the bottom edge of corner walls 36, 36', 36", 36'" in the formed container. Hingedly attached to the primary bottom flaps 40, 40', opposite the primary sidewalls 34, 34', are primary bottom tabs 61, 61'. Secondary bottom flaps 42, 42' are hingedly attached to the secondary side walls 38, 38'. Secondary bottom tabs 49, 49' are hingedly attached to the secondary bottom flaps 42, 42' opposite the secondary sidewall 38. The primary bottom flap 40 and the secondary bottom flap 42 are configured to substantially close the bottom of the container 54 when the container 54 is assembled. Additionally, the primary and secondary bottom tabs 61 and 49, respectively, are configured to interact with primary and secondary bottom tabs 61', 49', respectively, to substantially lock the bottom of the container 54.

Figure 4:
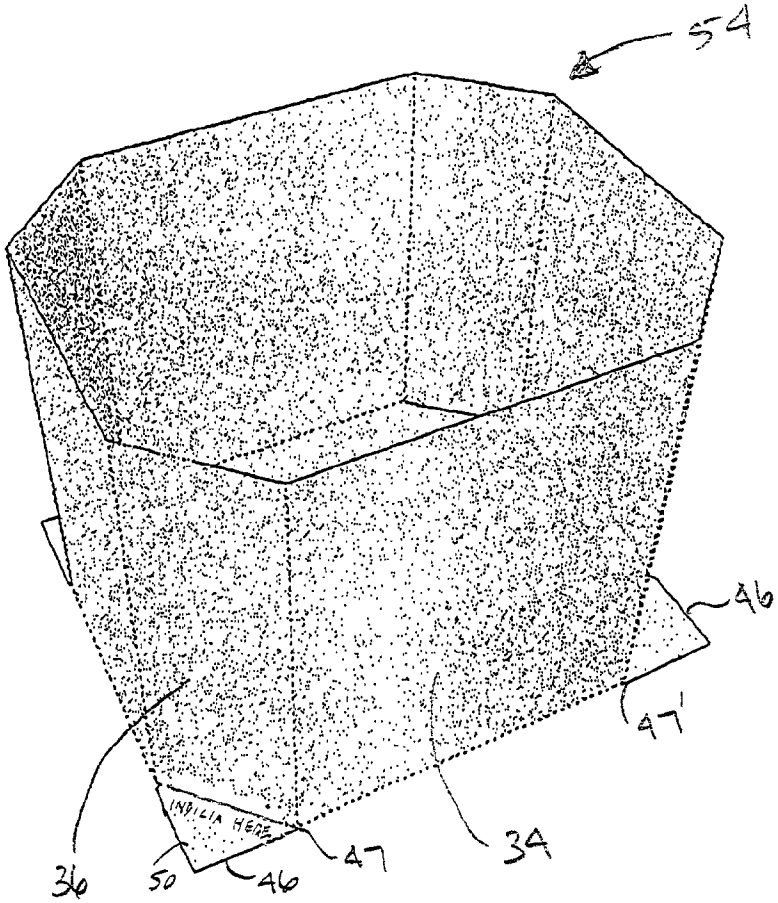
FIG. 4 is another perspective view of a container formed in accordance with the present invention.
Figure 3:
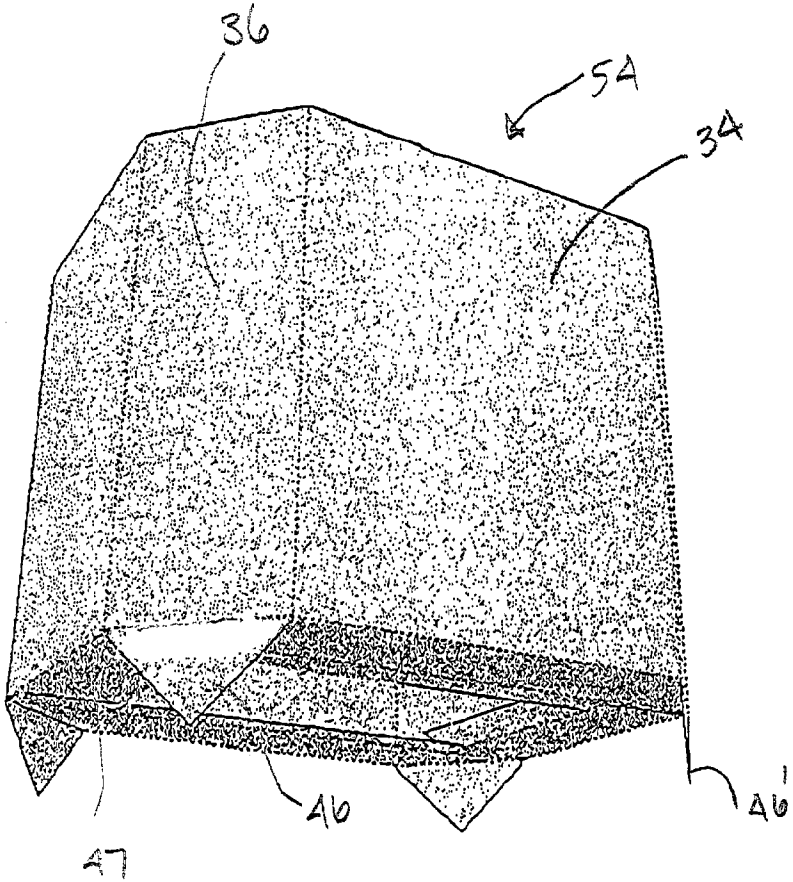
FIG. 3 is a perspective view of a container according to the present invention.

Referring now to FIGS. 3 and 4, the container 54 formed from the blank 30 of FIG. 2 is illustrated. As discussed above, the corner tabs 46, 46', 46", 46'" are formed such that they are attached to the container 54 only along hinge lines 47, 47', 47", 47'". Thus, the corner tabs 46, 46', 46", 46'" are free to pivot about the hinge lines 47, 47', 47", 47'", and when employed, the corner tabs 46, 46', 46", 46" are extended in an outwardly direction relative to the container 54, as illustrated in FIG. 4.

Figure 5:
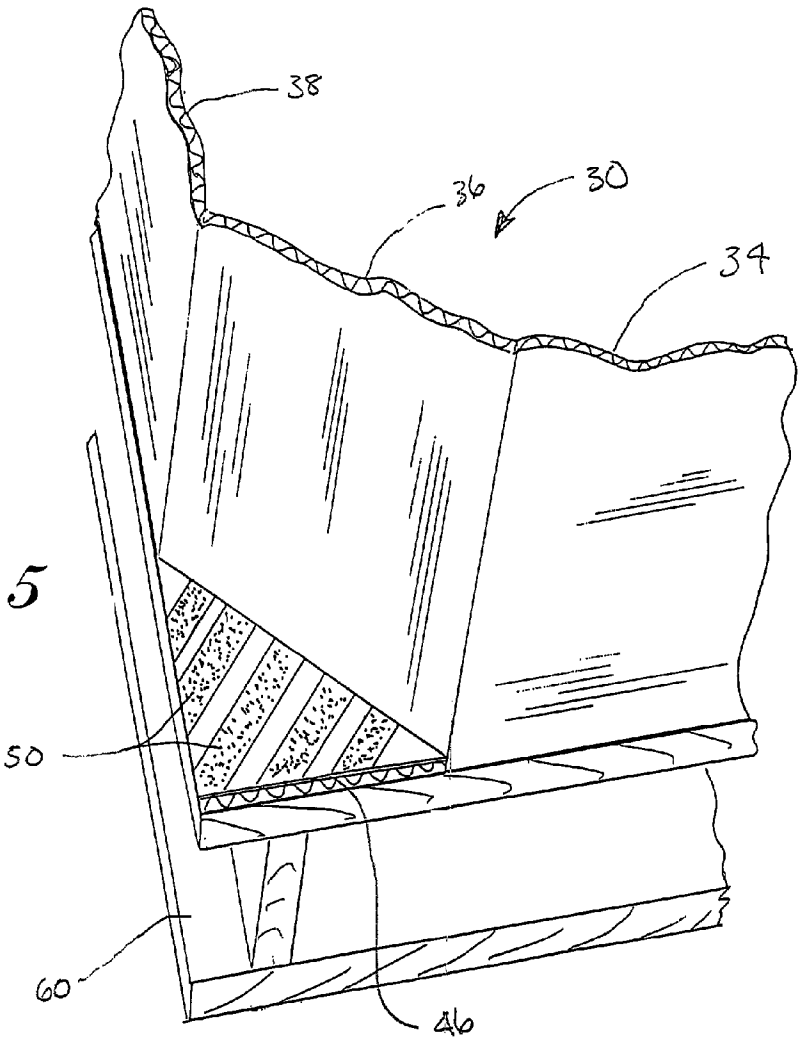
FIG. 5 is a partial perspective cut away of corner tab assembly formed according to an aspect of the present invention.

FIG. 5 depicts an isolated view of the corner tabs 46 in accordance with a preferred embodiment of the present invention. More specifically, container 54 is mounted on a supporting structure 60 such as, without limitation, a wooden pallet. The corner tabs 46, 46', 46", 46'" cover the otherwise exposed corners of the supporting structure 60, wherein the outer edges of the corner tabs 46, 46', 46", 46'" are aligned with the primary sidewalls 34, 34' and secondary sidewalls 38, 38'.

Upper surfaces of the corner tabs 46, 46', 46", 46'" include colorful indicia 50 printed thereon. The indicia 50 is preferably a plurality of brightly colored stripes. However, indicia 50 of any other nature is within the scope of this invention, such as without limitation, solid colors, or any other pattern or color arrangement that would command eye attention. Fluorescent or "day glow" colors are non-limiting examples of the types of colors preferably used with the present invention. Additionally, the indicia 50 may be an adhesive layer with a colored surface, such as a warning sticker or similar arrangement.

As depicted in the FIGURES, the upper surface of the corner tabs 46 is the same surface as the outer surface of the container 54. Consequently, the indicia 50 may simply be applied simultaneously with any printing on the outer surface of the container 54. Conversely, the indicia 50 may be applied in a separate step, independent from any other container marking process.

As will be appreciated from reading the above, the present invention avoids many of the problems or limitations of prior containers. The present invention is easy to set up and handle, and includes elements, which are used with a minimum effort. The present invention may be used with any container having truncated corners. The indicia may be formed on the corner tabs during any current printing or label printing process, thus, no significant process step changes are required. Finally, the present invention utilizes material that is otherwise considered waste or unwanted material.

While the preferred embodiment of the invention has been illustrated and described, as noted above, many changes can be made without departing from the spirit and scope of the invention. Accordingly, the scope of he invention is not limited by the disclosure of the preferred embodiment. Instead, the invention should be determined entirely by reference to the claims that follow.

What is claimed is:

1. A blank for a container having a plurality of sidewalls, corner walls, and bottom panels configured to form a container having truncated corners, the blank comprising:

a plurality of substantially triangular shaped corner tabs each having an upper surface; and an indicia on the upper surface;

wherein the blank is formed from a corrugated material.

2. The blank of claim 1, wherein the indicia is at least one of a colored stripe, solid field or pattern.

3. The blank of claim 2, wherein the colored indicia is at least one of a fluorescent or day-glow color.

4. A container having a plurality of sidewalls and a plurality of truncated corner walls interposed between the sidewalls and a plurality of bottom panels attached to a bottom region of the sidewalls and corner walls, the bottom panels being configured to close the bottom region of the container, the container comprising:

a substantially triangular shaped corner tab hingedly attached to a bottom edge of each said corner wall, said tab having two outer edge aligned with the adjacent sidewalls, the corner tabs having an upper surface; and an indicia on the upper surface of the corner tabs.

5. The container of claim 4, wherein the corner tabs are configured to extend outwardly of said container over a supporting structure placed under the container.

6. The container of claim 5, wherein the supporting structure is a pallet configured to attach to a bottom region of the container.

7. The container of claim 4, wherein the indicia is at least one of a colored stripe, solid field or pattern.

8. The container of claim 7, wherein the color of the indicia is at least one of a fluorescent or day-glow color.

9. A container blank comprising:

a pair of opposed primary sidewalls;

a pair of opposed secondary sidewalls;

a plurality of corner walls interposed between the primary sidewalls and the secondary walls, said walls being joined by hinge lines;

a trapezoidal primary bottom flap hingedly attached to each primary sidewall;

a plurality of substantially triangular shaped corner panels hingedly attached to each of said corner wall adjacent said bottom flaps, the corner panels having an upper surface thereon; and an indicia on the upper surface of the corner panel.

10. The blank of claim 9, wherein the indicia is at least one of a colored stripe, solid field or pattern.

11. The blank of claim 10, wherein the color of the indicia is at least one of a fluorescent or day-glow color.

* * * * *